US006651745B1

(12) United States Patent
Lush et al.

(10) Patent No.: US 6,651,745 B1
(45) Date of Patent: Nov. 25, 2003

(54) SUBSEA RISER SEPARATOR SYSTEM

(75) Inventors: David Lush, Houston, TX (US); Jonathan Eng, Sugar Land, TX (US); Hikmet Ucok, Bangkok (TH); Dave Hopgood, Missouri City, TX (US); Chris Landeck, Sugar Land, TX (US); Ken Carmon, Richmond, TX (US)

(73) Assignee: Union Oil Company of California, El Segundo, CA (US)

( * ) Notice: Subject to any disclaimer, the term of this patent is extended or adjusted under 35 U.S.C. 154(b) by 0 days.

(21) Appl. No.: 10/138,020

(22) Filed: May 2, 2002

(51) Int. Cl.[7] ..... E21B 29/12
(52) U.S. Cl. ..... 166/357; 166/267
(58) Field of Search ..... 166/357, 267

(56) References Cited

U.S. PATENT DOCUMENTS

| | | | | | |
|---|---|---|---|---|---|
| 3,252,439 | A | * | 5/1966 | Shatto, Jr. et al. | 114/257 |
| 3,602,701 | A | * | 8/1971 | Boyd, Jr. | 700/36 |
| 3,608,630 | A | * | 9/1971 | Wooden et al. | 166/357 |
| 3,643,736 | A | * | 2/1972 | Talley, Jr. | 166/356 |
| 4,046,191 | A | * | 9/1977 | Neath | 166/352 |
| 4,149,603 | A | * | 4/1979 | Arnold | 175/7 |
| 4,291,772 | A | * | 9/1981 | Beynet | 175/5 |
| 4,527,632 | A | * | 7/1985 | Chaudot | 166/357 |
| 4,577,700 | A | * | 3/1986 | Dellinger et al. | 175/40 |
| 4,651,836 | A | * | 3/1987 | Richards | 175/62 |
| 4,900,433 | A | * | 2/1990 | Dean et al. | 210/170 |
| 5,129,931 | A | * | 7/1992 | Oranje | 55/399 |
| 5,154,741 | A | * | 10/1992 | da Costa Filho | 96/157 |
| 5,488,993 | A | * | 2/1996 | Hershberger | 166/372 |
| 5,722,494 | A | | 3/1998 | Landeck et al. | 175/7 |
| 6,004,385 | A | * | 12/1999 | Birmingham | 96/174 |
| 6,062,313 | A | * | 5/2000 | Moore | 166/357 |
| 6,068,053 | A | * | 5/2000 | Shaw | 166/267 |
| 6,216,781 | B1 | * | 4/2001 | Knight | 166/105.5 |
| 6,276,455 | B1 | * | 8/2001 | Gonzalez | 166/357 |

OTHER PUBLICATIONS

Strand, B. and Bakke, W., "Subsea Separation on the Troll Field," Scandinavian Oil–Gas Magazine, Jul. 8, 1998, pp. 122–124.

Baggs, C., Kent, I., and Allen, John, "Troll Pilot Control System: Advanced Control System for a Subsea Separator," Offshore Technology Conference (OTC) 12154, May 1–4, 2000, pp 1–10.

Arnold, K.E. and Ferguson, P.L., "Tomorrow's Compact Separation Train," Hart's E&P, Dec. 1999, pp. 80–82.

Fjøsne, E., "Subsea Processing—Maximising Value in Areas With Existing Infrastructure," FMC Energy Systems, FMC Kongsberg Subsea, Offshore Technology Conference (OTC) 14008, May 6–9, 2002, pp. 1–5.

Eriksen, S., "How Can Subsea Processing Remove Processing Constraints," FMC Energy Systems/FMC Kongsberg Subsea, Aug. 30, 2001, 11 pages.

(List continued on next page.)

*Primary Examiner*—Robert E. Pezzuto
*Assistant Examiner*—Thomas A. Beach
(74) *Attorney, Agent, or Firm*—Yale S. Finkle; Gregory P. Wirzbicki; William O. Jacobson

(57) ABSTRACT

A preferred embodiment of the inventive fluid delivery system comprises a vertical liquid/vapor separator and riser assembly that comprises a multi-phase separator inlet, a vapor outlet and riser, and a liquid outlet port connected to a hydraulically-driven centrifugal pump. By controlling the operational speed of the pump, the level of the separated liquid within the separator can be controlled without the need for control valves. The vertical separator is capable of low pressure operation and large variations in controlled liquid levels within the separator, allowing the relatively slow reaction time pump to control the liquid level from low pressure wells penetrating low pressure reservoirs.

26 Claims, 2 Drawing Sheets

OTHER PUBLICATIONS

Davalath, J. "Economic Benefits of Compact Subsea Separation System," FMC Energy Systems, United States, Deep Offshore Technology 1999, 14 pages.

Songhurst, B.W. and Eyre, G.P., "Experience Gained From the First U.K. Subsea Separator," British Offshore Engineerig Technology, Offshore Technology Conference (OTC) 6423, May 7–10, 1990, pp. 43–50.

Smith, J.R., "The Highlander Field: Eight Years On," Texaco Norm Sea United Kingdom, Offshore Technology Conference (OTC) 7438, May 2–5, 1994, pp. 177–187.

Crook, J. "Seabed Separation First for Troll," Petroleum Review, Mar. 1999, p. 31.

"SUBSIS: Subsea Separation and Injection System," ABB Offshore Systems, ABB Oil, Gas & Petrochemicals, (undated), 4 pages.

"Subsea Separation and Injection by ABB's SUBSIS," ABB Offshore Systems , www.abb.com/oilandgas, Aug. 1999, 3 pages.

Davalath, J., Wessel, J., and Hatlo, A., "State of the Art in Subsea Pumping Technology," FMC Energy Systems, Nov. 7–9, 2000, 11 pages.

"Helico–Axial Multiphase Pump, Deepwater Technology," Multiphase, Guinard Pumps, Textron Fluid Handling Products, May 1989, 12 pages.

Technical Bulletin, "Increased Oil Production by Means of Subsea Processing," Framo Engineering AS, Bergen, Norway, Jan. 1999, 4 pages.

Technical Bulletin, "Boosting—Increased Oil Production and Recovering Utilizing," Framo Engineering AS, Bergen, Norway, Nov. 1999, 4 pages.

Technical Bulletin, "Subsea Multiphase Pumps for Shell, Draugen," Framo Engineering AS, Bergen, Norway, May 1999, 4 pages.

Technical Bulletin, "Framo Subsea Multiphase Booster Pumps for BP ETAP," Framo Engineering AS, Bergen, Norway, Apr. 1999, 4 pages.

"Subsea Multiphase Pump," Kvaener Eureka a.s., Lier, Norway, (undated), 6 pages.

Technical Bulletin, "Increased Oil Production by Means of Subsea Multiphase Boosting," Framo Engineering AS, Bergen, Norway, Nov. 1999, 4 pages.

Rekve, S., "Fourth–Quarter Seafloor Pump Demo Set," Hart's E&P 5$^{th}$ Deepwater Technology (undated), p. 31.

"Multiphase Booster Pumps Provide Efficient Production Tool," Hart's E&P 5$^{th}$ Deepwater Technology, (undated), p. 32.

Bradbury, J., "Pumping Up the Volume," Hart's E&P, Oct. 2001, p. 29.

"Hydraulic Turbine Drive Submersible Centrigual Pumps," Weir Pumps, Nov. 2001, pp. 1–2.

Harden, W.G. and Downie, A.A., "Field Trial and Subsequent Large–Scale Deployment of a Novel Multiphase Hydraulic Submersible Pump in Texaco's Catain Field," Offshore Technology Conference (OTC) 13197, Apr. 30–May 3, 2001, pp. 1–19.

Arnold, K.E. and Ferguson, P.L., "Tomorrow's Compact Separation Train," Hart's E&P, Dec. 1999, pp. 80–81.

* cited by examiner

SUBSEA RISER SEPARATOR SYSTEM

FIELD OF THE INVENTION

This invention relates to the offshore resource-recovery devices and processes. More specifically, the invention is concerned with improved oil and gas or other multi-phase fluid production from offshore subsea wells, especially from ultra-deep offshore wells.

BACKGROUND OF THE INVENTION

Some offshore resource recovery activities, e.g., withdrawal of hydrocarbon fluids from a subsurface reservoir through a well tubular and riser assembly to surface fluid delivery facilities, have previously been accomplished using an offshore platform. The offshore platform typically supports at least a portion of the riser and fluid delivery facilities and other equipment needed to process and recover resource fluids.

For shallow water depth locations, a well and fluid delivery system typically includes a riser and the remainder of the fluid delivery system that is generally located on a rigid platform structure fixed to a seafloor anchor or foundation. For deepwater offshore platforms locations, e.g., offshore platforms located in waters having a depth exceeding about 1,500 feet (or about 457 meters), this type of fixed tower structure is typically not cost effective, and other types of facilities may be used, e.g., subsea wellheads and delivery systems.

As the distance between the subsea wellheads and surface processing facilities increases, e.g., due to increasing water depths, the addition of external energy to the recovered fluids may become necessary to recover commercial quantities of oil or other fluids from deepwater reservoirs. For wells in deepwater locations, especially in ultra deepwater locations (herein defined as water surface to mudline depths of at least about 10,000 feet or 3,000 meters), the addition of external energy may extend the working range of reservoir pressures that can be produced. The additional external energy can be a major factor in producing commercial flowrates of oil and gas from these deepwater or ultra-deepwater resources.

One of the items of equipment that may be required to process and recover commercial quantities of oil and/or gas from deep, multi-phase reservoirs is a pump. The pump must be able to handle multi-phase fluids such as oil with lighter hydrocarbon or inert gases, oil with steam or flashing hot brine, slurries, or other fluid-like mixtures of components having density differences.

SUMMARY OF THE INVENTION

One embodiment of the inventive fluid delivery system comprises a vertical, low-pressure fluid separator and integral vapor riser assembly having a liquid outlet port connected to a pump assembly, preferably hydraulically driven. The pump assembly increases the pressure of the separated liquid allowing the delivery of pressurized liquid to other fluid handling facilities at the surface. The pump speed is simultaneously controlled to limit the range of vapor/liquid interface levels within the separator. The large variation in liquid interface levels within the vertical separator also allows the use of a subsea hydraulically-driven pump (typically having a relatively slow reaction time especially if hydraulically driven from a surface source of pressurized fluid) even during periods of system upsets. Because of the system upset tolerance, the relatively open system design, and simplicity of the operating controls, the present invention is expected to be reliable, safe, and cost effective. Moreover, the removal of most of the liquid-phase from the vapor riser allows a minimum operating or reservoir abandonment pressure, minimizing the backpressure on the subsea well.

BRIEF DESCRIPTION OF THE DRAWINGS

In these Figures, it is to be understood that like reference numerals and letters refer to like elements or features, or to elements or features functioning in like manner.

DETAILED DESCRIPTION OF THE INVENTION

Figure 1:
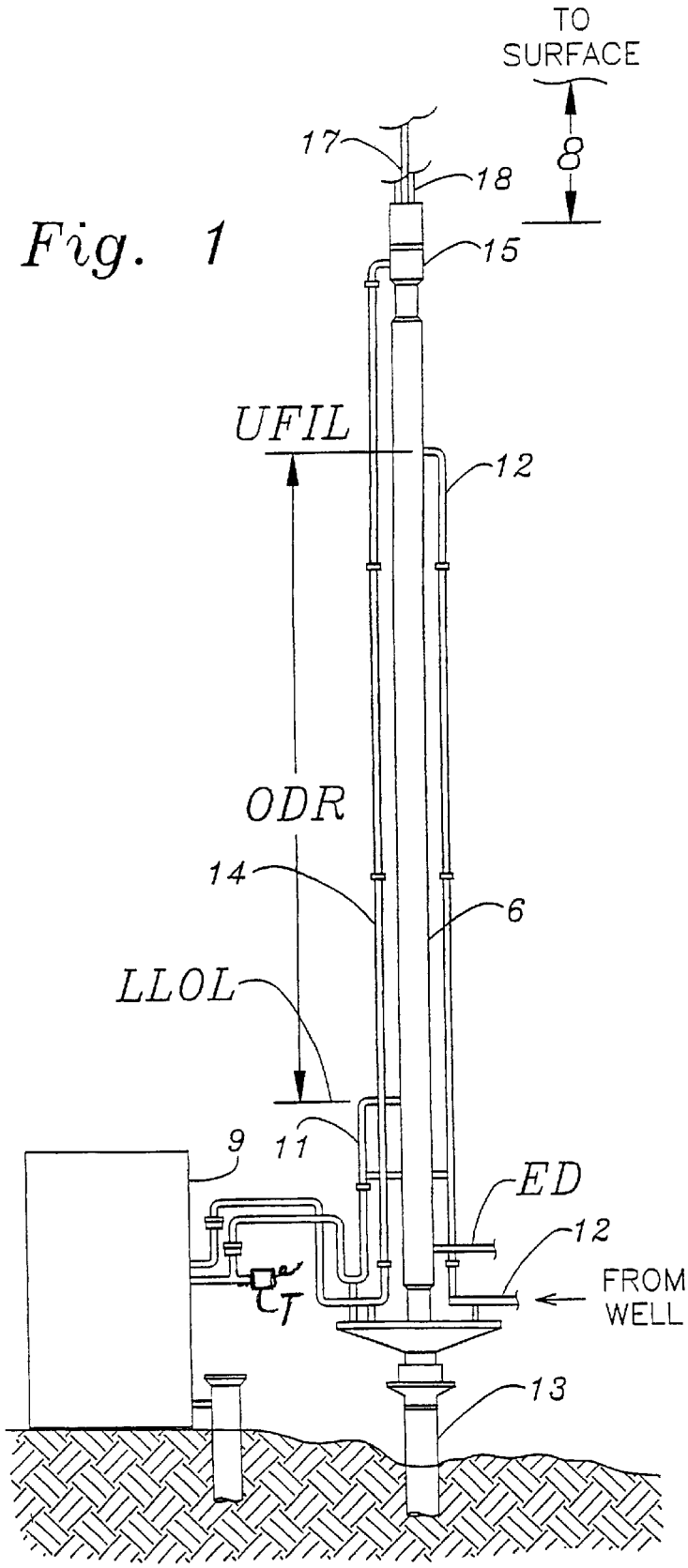
FIG. 1 shows a side view of a subsea separator, riser and pump assembly supplied by a multi-phase fluid mixture.
Figure 2:
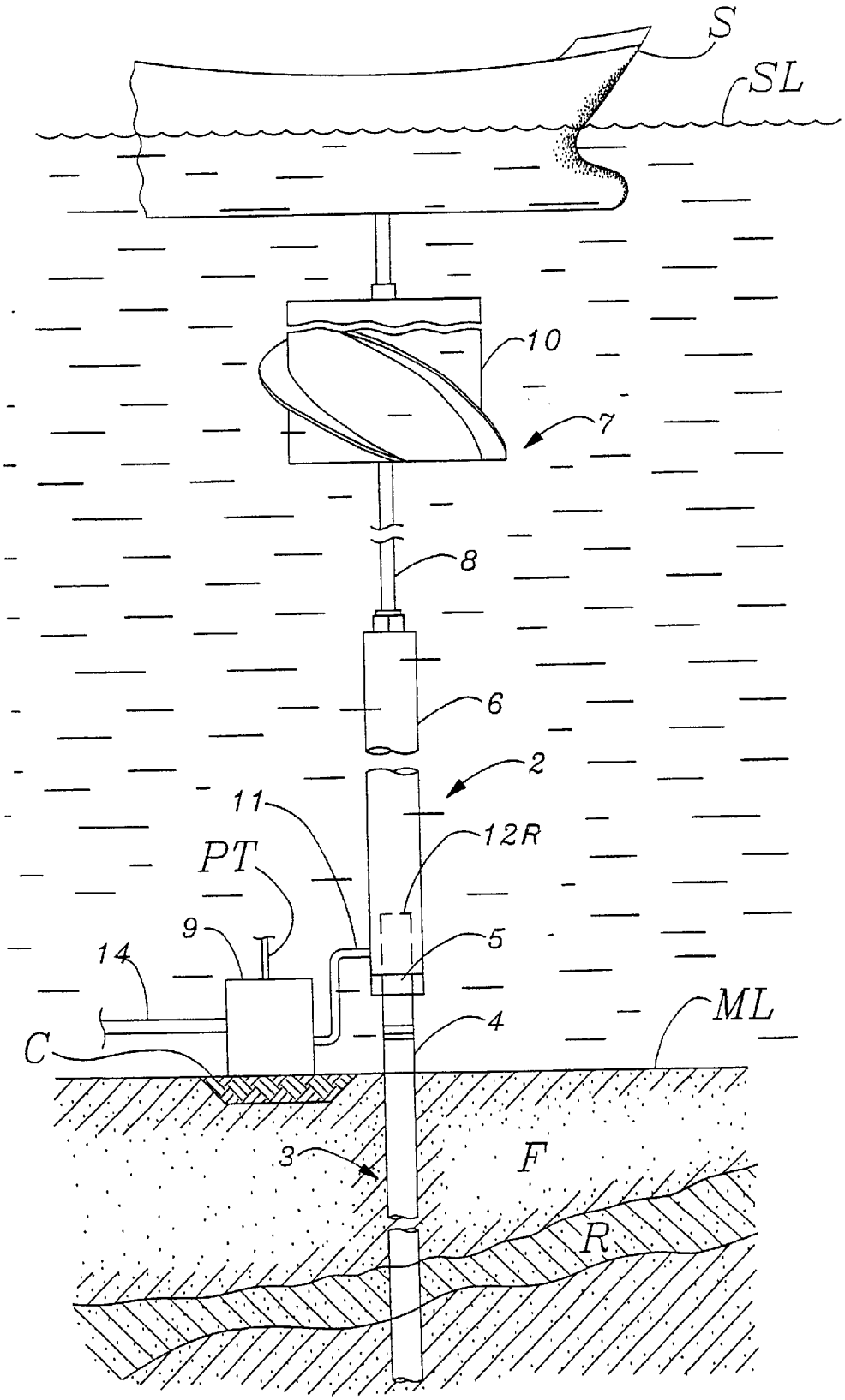
FIG. 2 shows side view of an alternative subsea separator, riser, and pump with the separator directly connected to the subsea well.

FIG. 1 shows a side view of a tubular vertical separator 6 supported by a piling 13 and a liquid or dense fluid pump assembly 9 similar to the comparable devices shown in FIG. 2. The preferred elongated tubular separator 6 in FIG. 1 is essentially composed of one or more pipe sections or other cylindrical elements having a nominal diameter larger than the nominal diameter of the concentric riser assembly 8 similar to that described for the elongated vertical separator 6 shown in FIG. 2. The tubular separator 6 shown in FIG. 1 comprises at least one multi-phase fluid inlet 12, at least one liquid or more-dense fluid outlet 11 connected to the pump assembly 9, and at least one vapor or less-dense-phase fluid outlet connected to a riser assembly 8.

The multi-phase fluid inlet line 12 is in fluid communication and is thus supplied by a subsea well (not shown in FIG. 1) or a manifold connected to a plurality of subsea wells. The pressurized outlet line 14 from the pump assembly 9 is connected to a connector block 15 and fluidly connected to the interior tubing 17 of a two-concentric-piped riser assembly 8. However, some applications may use a separate vapor riser and pressurized liquid piping or riser system, e.g., see FIG. 2.

In the embodiment shown in FIG. 1, the inlet port and line 12 typically supplies a multi-phase mixture of liquids (e.g., crude oil, water and/or gas condensates) and vapors (such as carbon dioxide, methane and other light hydrocarbon gases) from a spaced apart well to the tubular separator 6. The entry direction of the multi-phase mixture to the tubular separator 6 includes a tangential component, forcing the multi-phase fluid into a whirling or cyclonic motion constrained within the diameter of the tubular separator 6. The cyclonic motion tends to force heavier liquids or more dense fluids to the circumferential walls of the tubular separator 6 while allowing gravity to drain the separated liquids near the walls towards the bottom or lower outlet. As flowrates increase, the whirling speed within the tubular separator may also increase, tending to improve separation efficiency (as compared with a horizontal separator where increased flow rates tend to degrade separator efficiency).

The capability of the inventive system to handle varying flow rates of liquid is especially important as reservoir (water and well) depths increase and/or non-vertical subsea well sections are used. The severity and/or possibility of slug flow (e.g., periods when the well produces essentially all liquid flow followed by periods when the well produces essentially all gaseous flow) and other mixed flow variations tend to increase with increasing well depths and/or lengths, especially in horizontal well segments. Unless the wide variations in mixed flowrates can be tolerated or smoothed out by the separation system, unacceptably wide variations in delivered flowrates and shutdown of the well are possible. Slug flow can also damage pipelines and equipment, so separation and smoothing of liquid and vapor flowrates can also assist in the safe operation of the hydrocarbon producing system.

The separated liquid from the tubular separator 6 is withdrawn through the lower outlet line 11 and conducted to a pump assembly 9. The pressurized liquid from the pump assembly 9 is conducted through the pump discharge line 14 and a riser connector block 15 to an inner conduit 17 (shown cutaway and dotted within the outer conduit 18 of the generally concentric riser assembly 8). The separated vapor or less dense fluid from the tubular separator 6 rises through the connector block 15 to the annulus outside of the inner conduit 17 and within the concentric riser assembly 8. In alternative embodiments, the pressurized and separated liquid from the pump assembly 9 can be conducted to other devices besides the concentric riser strings 8, e.g., conducted to the surface using a separate dedicated (liquid) conduit or riser string, conducted to a liquid collector or manifold, conducted to an injection well, conducted to a water-oil separator or, other processing facilties, or conducted to an oil export pipeline or other flowline.

The concentric riser strings 8 preferably comprise 30–50 foot (9.14–15.2 meter) sections of 12–16 inch (30.5–40.6 cm) nominal diameter N-80 pipe having a nominal wall thickness of 1–1½ inches (2.54–3.81 cm) for the outer pipe string 18 and 30–50 foot (9.14–15.2 meter) sections of 6–10 inch (15.2–20.5 cm) nominal diameter N-80 pipe having a nominal wall thickness of ½–1 inch (1.27–2.54 cm) for the inner conduit or pipe string 17. The concentric riser assembly 8 also typically comprises couplings, instrumentation and control cabling/hydraulic fluid tubing. A minimum internal diameter of the inner tubing string 17 is preferably at least about 4 inches (10.2 cm), more preferably at least about 6 inches (15.2 cm) to allow cable tools to be lowered through the concentric riser assembly 8 and tubular separator 6.

The riser assembly 8 conducting generally vapors from the tubular separator 6 to at or near the surface allows low-pressure operation of the tubular separator. Instead of an internal pressure comparable to the external pressure or the pressure head of produced liquids in a riser at the deepwater or ultra-deepwater location, the vapor riser and thick wall construction of the tubular separator 6 allows the separator to operate at much reduced pressures, preferably less than ½ the external subsea pressure for low pressure reservoirs, more preferably less than about 500 psi, and still more preferably less than about 200 psi for depleted reservoirs.

In one embodiment, the tubular separator 6 is essentially a widened and generally open portion of one or more riser tubular sections. The tubular separator 6 typically has a nominal diameter of no more than about 3 feet (0.94 meter) for the embodiment shown. Although there is no theoretical limit on the nominal diameter of the tubular separator 6 or vertical separator shown in FIG. 2 in other embodiments, the nominal diameter of the tubular separator typically varies from about 24 inches to 36 inches (or about 61.0 to 91.4 centimeters). This allows the tubular separator 6 to be picked up, handled, and installed mostly using handling equipment used for riser sections.

The overall length of the elongated tubular separator 6 can be a significant portion of the entire length of the riser assembly 8 if needed, but is more typically in the range of at least about 30 feet (9.14 meters) and less than about 100 feet (30.5 meters), more preferably at least about 60 feet (18.3 meters), and for some applications, most preferably at least about 80 feet (24.4 meters). In the most typical range of lengths, the vertical separator is essentially a widened extension of the outer conduit 18 of the riser assembly 8, e.g., composed of large riser tubular sections welded or otherwise joined together with a reducer at the upper end to connect to the rest of the riser assembly. A pipe end cap may also be provided for support at the lower end of the separator.

The operation of pump assembly 9 is preferably controlled by the pressure of the separated liquid sensed in the lower outlet line 11*a* as an indicator of liquid interface level in the separator. In an alternative embodiment, the pressure at a second port (e.g., at the second or emergency outlet port ED) is also sensed, and the pressure difference is used to control the operation of pump assembly 9. The liquid pressure or pressure difference is an indication of the height of the separated liquid within tubular separator 6 or between ports. Because of the significant distance ODR between the lower liquid outlet level LLOL and upper fluid inlet level UFIL, the height of separated liquid within the vertical separator can vary widely, e.g., can range from at or near the lower liquid level outlet to at or near the upper fluid inlet level. Preferably, the separator nominally functions with a liquid height midway between the multi-phase inlet level UFIL and the liquid outlet level LLOL, but can vary to as high as near the connector block 15 or as low as near a second or emergency liquid outlet ED, e.g., the fluid interface level can vary by about 40 feet or 60 feet (12.2 or 18.3 meters) or more.

Instead of using the sensed liquid pressures at the liquid outlet line 11 to control the flow and operational speed of pump assembly 9 and maintain the level of separated liquids within a controlled range within vertical separator 6, alternative embodiments control the flow of separated fluids by other means. Other flow control means can include using signals indicating liquid pressures to operate control valves in the lower outlet line 11 or release additional liquids to a second outlet line and port ED, using the presence and/or absence of fluid at one or more outlets in a vertical separator to control pump speed, and using ultrasonic or other liquid level sensors and the rate of indicated level change to control valves (not shown) and/or pump operational speed.

In a preferred embodiment, the pump element of pump assembly 9 may be a centrifugal or other pump type that tends to vary in volumetric flowrate with changes in net positive suction head (NPSH) at the fluid inlet. If this type of pump is used, pump assembly 9 and tubular separator 6 may be, at least in part, self regulating, i.e., the pump flowrate falls as the NPSH and liquid level falls until minimal flow is discharged at minimum NPSH or essentially little or no liquid flow is discharged when the liquid level falls below the minimum NPSH. Conversely, at the maximum height of liquid in tubular separator 6, pump flowrates and operating efficiency are maximized, tending to lower the level of separated liquid in the vertical separator.

The preferred configuration incorporates a centrifulgal pump assembly 9 combined with a differential pressure transducer T in the liquid outlet line 11 to control the speed (and flowrate) of the separated liquid removed from tubular separator 6. The preferred pressure transducer is supplied by Corr Ocean locate in Oslo, Norway.

The preferred hydraulic pump assembly 9 is supplied by Weir Pumps located in Glasgow, Great Britain. A drive fluid, e.g., water supplied by surface pumps and transmitted to the pump assembly 9 through control tubing extending from the surface drive-fluid pumps to near the mudline, drives the pump assembly 9. Pump speed variation (and/or other controls) as well as the self-regulating characteristics of the system are used to generally maintain the liquid interface level between the upper fluid inlet level UFIL and the lower liquid outlet level LLOL. The distance or depth difference between the inlet and outlet levels UFIL and LLOL is preferably at least about 30 feet (9.14 meters), more preferably at least about 50 feet (15.2 meters), and nominally about 80 feet (24.4 meters).

The process of using the fluid delivery system 2 for normal multiphase flowrates (e.g., separating vapor and liquid from a mixed flow inlet stream) involves controlling the pump speed as a function of the height/pressure of the separated liquid in the vertical separator 6. If the liquid inflow rate from the well increases and the liquid interface level rises, the pump speed will be increased to reduce the liquid level in the separator. If the liquid interface level in the tubular separator 6 falls, the pump can be slowed or shut down to generally maintain the desired liquid interface level.

The preferred hydraulic pump and/or control system typically has a relatively slow response time, e.g., at least about 20 seconds and more typically about 60 seconds. This is especially true if portions of the control system are located at the surface requiring signals (e.g., fluid pressure or electrical signals) to travel from a deep subsea location to the surface and/or the power fluid to be delivered from the surface to drive the hydraulic pump at the subsea location. The elongated height of vertical separator 6 (shown in FIG. 2) or tubular separator 6 (shown in FIG. 1) allows a wide variation in liquid levels, allowing response times to vary to as much as 120, but more typically no more than about 180 seconds.

An advantage of the inventive separation system is reliability. The preferred embodiment comprises hydraulic pumps to avoid potential problems with electric-driven submersible pumps, e.g., power cable insulation breakdown, shorting, cooling surface contamination, galvanic corrosion, and other reliability problems. The use of power fluid components located at the surface makes these components easily accessible for maintenance and repair. Avoiding the need for control valves by controlling the speed of the hydraulic pump assembly 9 avoids potential problems of stuck valves, loss of control valve signals, contamination blockage of the control valves, and other valve reliability problems. Using tubular sections for the riser and tubular separator assemblies reduces potential damage by improper handling and improper connection designs. The use of tubular sections also makes for ease of handling, since rig crews are familiar with this type of equipment. Placing the essentially vertical riser on top of the nominally vertical tubular separator allows direct maintenance and repair access to the separator using wire line tools or other reliable well maintenance and repair procedures and tools well known in the art.

Other advantages of the invention are improved efficiency and performance. The lack of control valves in the preferred embodiment avoids a pressure loss associated with control valves. The relatively open design of the tubular separator and direct coupling of the riser avoids additional losses. In addition to acceptable fluid pressure losses, the swirling motion of the fluids in the tubular separator results in good separation efficiency, especially for two phase mist flow, which tends to be difficult to separate in horizontal separators.

FIG. 2 shows a schematic side view of an alternative embodiment of the inventive subsea fluid delivery system 2 directly connected to a well tubular 4 extending from an offshore oil & gas well 3 penetrating an underground reservoir R. Although the inventive fluid delivery system 2 shown may be connected to other onshore or offshore wells in shallower water depths penetrating reservoirs at various pressures, the system is expected to be most applicable to deep offshore wells penetrating low pressure reservoirs R and located in deepwater locations, especially ultra-deep water locations. Low pressure reservoirs is herein defined as having a static pressure of less than the head pressure of sea water at about the depth under sea level where the reservoir is located. Even if a reservoir is initially not classified as a low-pressure reservoir, commercial production may cause the reservoir pressures to decline over time so that the reservoir, especially near commercial depletion, is classified as a low-pressure reservoir at a later time.

The offshore or subsea well 3 has one or more strings of tubular sections 4 that extend generally downward from at or near a mudline level ML through formation F to at least a reservoir R with the tubulars typically cemented in place. The offshore well 3 may produce a mixed phase fluid, e.g., a crude oil/condensate and natural gas mixture. The well tubular sections 4 are fluidly connected to an inlet port of vertical separator 6 having at least two outlets, an upper outlet connected to a riser assembly 8 and a lower outlet connected to a pump assembly 9. Because vapor removal is via a relatively open gas riser 8*a* and the liquid is removed by pump assembly 9, back-pressure on the well 3 can be reduced to as little as a few psig or the back-pressure generated by a column of low pressure gas extending from near the mudline to the surface level SL. Although internal pressures in the vertical separator 6 can be as much as 5000 psig or more, they more typically range from about 50 psig to several thousand psig. For very low pressure or depleted reservoirs, vertical separator pressures may be no more than about 500 psig or even 200 psig.

The collected and pressurized liquids from pump assembly 9 are typically pumped to the surface by increasing the pressure to at least that required to overcome the back-pressure generated by a column of separated liquid extending from near the mudline to the surface. The riser/separator configuration allows low pressure liquid and/or vapor fluid streams to be produced from the formation F or, in a similar alternative embodiment, low pressure liquid and vapor sources at the surface to be injected to a low pressure reservoir. In contrast to prior art multiphase pumping systems, the direct connection of the generally vertical riser and separator promotes efficiency and availability of the oil and gas production system. When coupled with a preferred hydraulic pump, the inventive system allows simplified operation over a wide variety of varying inflow conditions.

In contrast to the embodiment shown in FIG. 1, the offshore well 3 in FIG. 2 directly supplies mixed-phase fluid flow as input to the vertical separator 6 through an extended nozzle 12 that protrudes into vertical separator. In alternative embodiments, similar vertical separators, risers, and/or pumped fluid delivery systems may also be supplied by multi-phase flow pipelines, subsea solution mining wells, geothermal wells, and other subsea sources of a fluid mixture requiring some type of separation.

The subsea well 3 typically comprises several types of well tubulars 4, e.g., a casing string, a liner string, and a production string. Some of the tubular sections can have nominal diameters of 30 inches (76.2 cm) or 36 inches (91.4 cm) or more, but a typical well tubular connected to the separator 6*a* has a nominal diameter typically less than about 13 inches (33.0 cm).

A connector 5 is used to attach well tubular 4 to a vertical separator 6. The connector 5 not only provides a duct-like passageway for fluids, but at least also partially supports vertical separator 6. Although connector 5 is typically weldably connected to well tubular 4 and the vertical separator 6, bolted, threaded, or other means for connecting the well tubular to the vertical separator may be used. Because of potentially severe bending and other loads on the connector 5, the connector typically has a wall thickness greater than the vertical separator 6, well tubulars 4, and/or the tubular riser sections 7 extending down from the ship or surface platform S.

Both the tubular separator 6 shown in FIG. 1 and the vertical separator 6 shown in FIG. 2 can be distinguished from prior art horizontal separators. For example, the separators 6 include a two-phase fluid inlet 12 imparting a flow direction typically having a radial component and a tangential component. The fluid inflow impinges on the internal walls of vertical separator 6, causing a generally swirling internal fluid flow around a nominally vertical centerline. Separation is typically accomplished, at least in part, by the swirling motion that tends to throw denser fluids (e.g., liquid droplets) outwardly. The swirling liquid or other denser fluids coalesce on the walls and then gravity-flow downwardly towards outlet line 11 while the less-dense swirling fluids (e.g., gases) "float" upward and inward to be withdrawn from an upper and more central outlet connected to the vapor riser assembly 7.

Other types of separation methods may be used to supplement the essentially open, swirling action previously described for the vertical separator and tubular separator 6, e.g., providing (within the vertical separator) tortuous fluid paths, baffles, trays, screens, hydrocyclones, or other internal components. Some of these other separation devices and methods depend at least in part on differences in fluid wetting properties providing added "wetted" surface area to supplement extended height/swirling action of the vertical separator or tubular separator 6. These supplementary separation devices may be removable (e.g., attached to a removable fluid inlet 12) or located at or near the walls of the vertical separator or tubular separator 6 so as not to interfere with the generally open interior of the separator.

Because of the internal swirling fluid motions, vertical orientation, and elongated interior shape of vertical separator or tubular separator 6, the separated liquid (or denser-fluid-phase) interface level within the separator may be varied over most of the entire height of the separator with little or no adverse impact on separation efficiencies. In addition, adding to the elongated height of the vertical separator or tubular separator 6 allows each fluid phase entering the separator more time within the separator before separately exiting, thereby improving separation efficiency.

In one embodiment with limited flowrates and/or not requiring extremely low back-pressure operation, the vertical separator 6 is similar to the tubular separator 6 in that it is composed of one or more well or riser tubular sections having thick walls. Use of available tubular section is possible since the nominal horizontal dimension or diameter of the vertical separator in this embodiment is equal to or less than the nominal diameter of available large risers, drill pipe, and/or other well tubular sections and the wall thickness is sufficient to withstand the differences in external and internal pressures. This allows common tools and/or procedures to be used for the vertical separator 6 and other tubulars, simplifying handling, installation, maintenance and repair. In other applications where even lower pressure and higher flowrates require larger, thicker-walled construction of a vertical separator 6, e.g., over 36 inches (91.4 cm), especially over 48 inches (121.9 cm) in nominal diameter with more than a two inch (5.08 cm) wall thickness, cylindrically-shaped and welded forging sections can be used instead of pipe or other well tubulars.

The pump assembly 9 is connected to and supplied by the liquid (or more-dense-phase) fluid outlet 11 of vertical separator 6. After the pump typically increases the pressure of the liquid to about the external (or seawater) head pressure at the subsea location or at least the head pressure of the pressurized liquid at that location. The discharge line 14 typically ranges from about 2 to 12 inches (5.08 to 30.5 cm) in diameter and may use thinner wall tubing or piping than the fluid outlet line 11. The discharge line 14 transfers the separated and pressurized liquid to other fluid handling devices, e.g., liquid storage facilities on the surface ship S. The liquid outlet line 11, discharge line 14, and hydraulic pump assembly 9 are at least partially supported by a piled or cemented footing foundation C located at or near the sea floor or mudline ML.

Pressurized power fluid (e.g., water) to drive the preferred hydraulic pump assembly 9 can be supplied from a surface pump or pressurized liquid supply at the surface. The pumped or otherwise pressurized liquid is conducted to the hydraulically driven pump assembly 9 through at least one pump tubing line PT, more typically a supply and return tubing pair. The tubing line(s) PT are characteristically composed of carbon steel, but may be also be composed of other materials.

The riser assembly 7 is connected to the vapor or less dense fluid outlet of the vertical separator 6. The riser assembly 7 is at least partially supported by a buoyancy can 10, but may also be supported by ship S, a buoy, platform or other means for supporting the riser assembly.

In one embodiment, riser assembly 7 comprises nominal 30–50 foot (9.14–15.2 meter) sections of 10–14 inch (25.4–35.6 cm) nominal diameter N-80 pipe having a nominal wall thickness of ¾–1¼ inches (1.90–3.18 cm). Besides the riser sections 8, the riser assembly 7 may be composed couplings, instrumentation and control cabling/hydraulic fluid tubing. Typically, a minimum internal diameter of at least about 4 inches (10.2 cm), preferably at least about 6 inches (15.2 cm), is maintained to allow cable tools to be lowered through the riser assembly 7 and vertical separator 6.

The mixed fluid inlet 12R of the vertical separator can include a removable protruding and offset nozzle, but may also include deflectors, baffles, and other devices to generate a swirling motion. Removability of the fluid inlet 12R allows cable tool access to the directly-connected well 3, and adjustment and/or replacement of the fluid inlet/nozzle for different quality fluid mixtures.

FIG. 2 shows a floating drill ship, barge, or other surface platform S fluidly connected to the buoyancy can 10 and the vertical separator 6 with a portion of the riser assembly 7. In alternative embodiments, the riser assembly 7 may be connected to a ship S that is horizontally offset from the over-well position shown. In other embodiments, the drill ship may be supplemented or replaced by a spar, tension leg platform, semi-submersible vessel, or other surface fluid handling facility. In still other embodiments, instead of the vapor outlet of the vertical separator 6 being directly connected to a riser assembly 7, the riser assembly can include an emergency dump valve (e.g., similar to the second or emergency port and valve ED attached to the tubular separator 6 as shown in FIG. 2) connected to buoyed flare stack, temporary storage tanks (e.g., bladders), a secondary vapor handling facility, or other fluid-handling devices.

Still other alternative embodiments are possible. These include: a series of vertical separators designed for different flow and fluid quality ranges instead of a single separator (e.g., a first separator efficiently separating a portion of the range of expected fluid conditions and assisting in separating the remainder of the inputs prior to being more fully separated in a subsequent separator), using a pump within the vertical separator instead of a pump external to the separator, using a mixer or other pre-treatment of the multi-phase fluid upstream of the vertical separator (e.g., to smooth out slug flow), having at least a portion of the pump and separator system composed of hardened materials (e.g., to handle slurry flow), and having the vertical separator placed substantially within or below a bladder or other type of gaseous containment enclosure allowing gases to be vented during system upsets.

Although the preferred embodiment of the invention has been shown and described, and some alternative embodiments also shown and/or described, changes and modifications may be made thereto without departing from the invention. Accordingly, it is intended to embrace within the invention all such changes, modifications, and alternative embodiments as fall within the spirit and scope of the appended claims.

What is claimed is:

1. An apparatus for recovering fluids from a subsea well located at a water depth of at least about 1,500 feet from a surface location, said apparatus comprising:

a fluid separator having a nominal vertical dimension larger than a nominal horizontal dimension, said fluid separator capable of operating at an internal pressure of no more than about half of the external pressure and having a multi-phase fluid inlet;

a transducer producing a signal that is at least in part dependent upon a fluid interface level within said fluid separator;

an upper, less-dense fluid outlet of said fluid separator fluidly connected to a riser assembly that extends from said fluid separator to a near surface location;

a hydraulically-driven pump fluidly connected to a lower, more-dense fluid outlet of said fluid separator, wherein the operational speed of said hydraulically driven pump is at least in part controlled by said signal produced by said transducer.

2. The apparatus of claim 1 wherein said hydraulically driven pump is located outside of said fluid separator.

3. The apparatus of claim 2 wherein said riser assembly and said fluid separator are composed of tubular sections and wherein said fluid separator has a nominal diameter of no more than about 36 inches.

4. The apparatus of claim 3 wherein said fluid separator and said riser assembly have nominal internal diameters of at least about 12 inches.

5. The apparatus of claim 4 which also comprises a removable mixed fluid inlet.

6. The apparatus of claim 5 wherein said fluid separator has a nominal internal diameter of no more than about 30 inches.

7. The apparatus of claim 6 wherein said fluid separator has a vertical height of about at least 30 feet.

8. The apparatus of claim 7 wherein said fluid separator has a vertical height of about at least 50 feet.

9. The apparatus of claim 8 wherein said fluid separator has a vertical height of about at least 80 feet.

10. The apparatus of claim 9 wherein said hydraulic pump and a liquid-level interface within said fluid separator form a partially self-regulating liquid-level interface controller.

11. The apparatus of claim 10 wherein said separator is capable of operating at an internal pressure of 500 psi or less.

12. The apparatus of claim 11 wherein said separator is capable of operating at an internal pressure of 200 psi or less.

13. An apparatus for separating fluids from a multi-phase fluid source, said apparatus located at a water depth of at least about 1,500 feet from a surface location, said apparatus comprising:

a fluid separator capable of operating at an internal pressure of about ½ of the external pressure or less and having a nominal vertical dimension larger than a nominal horizontal dimension, said fluid separator comprising well tubular sections and having at least one inlet fluidly connected to said multi-phase fluid source;

an upper fluid outlet of said fluid separator fluidly connected to a riser assembly that extends from said fluid separator to a near-surface location; and a centrifugal pump fluidly connected to a lower fluid outlet of said fluid separator, wherein the operational speed of said pump is at least in part controlled by a fluid level interface within said fluid separator.

14. The apparatus of claim 13 wherein said pump is a hydraulic pump located outside of said fluid separator.

15. The apparatus of claim 14 wherein said pump is capable of operating when the height of said fluid level interface within said fluid separator varies by as much as 40 feet.

16. The apparatus of claim 15 wherein said riser comprises at least two concentric conduits.

17. The apparatus of claim 16 wherein the nominal diameter of said fluid separator is about 4 feet or less.

18. A process for recovering fluids from a subsea well comprising:

fluidly connecting said subsea well to a fluid inlet of a subsea vertical separator;

fluidly connecting a riser assembly to an upper fluid outlet of said subsea vertical separator;

fluidly connecting a hydraulically-driven pump to a lower outlet of said subsea vertical separator separator;

determining a fluid level within said subsea vertical separator; and controlling the internal pressure within said vertical separator to ½ the external pressure or less and controlling the operational speed of said hydraulically-driven pump using at least in part said determined fluid level.

19. The process of claim 18 wherein said controlling step uses at least in part a self-regulating output characteristic of said hydraulically driven pump and said hydraulically driven pump has a response time of at least 20 seconds in response to changes in liquid interface level within said vertical separator.

20. An offshore apparatus for separating fluids from a multi-phase fluid source, said apparatus located at a water depth of at least about 1,500 feet from a surface location and subjected to the external water pressure at that depth, said apparatus comprising:

a fluid separator capable of operating at an internal pressure of no more than about half of said external water-pressure and having a nominal vertical dimension of at least about 30 feet and a nominal horizontal dimension of no more than about four feet, said fluid separator fluidly connected to said multi-phase fluid source;

a tubular assembly fluidly connected to an upper fluid outlet of said fluid separator, said tubular assembly extending from said fluid separator to a near-surface location; and a pump fluidly connected to a lower fluid outlet of said fluid separator, wherein said pump is capable of operating with a fluid interface level within said separator that can vary at least about 30 feet along the nominal vertical dimension.

21. The apparatus of claim 20 wherein the operational speed of said pump is at least in part controlled by said fluid interface level within said fluid separator and wherein said fluid separator comprises diametrically expanded sections of said tubular assembly.

22. An offshore apparatus for separating different fluids from a fluid source, said apparatus located at a water depth of at least about 1,500 feet from a surface location and said apparatus subjected to the external water pressure at that depth, said apparatus comprising:

a fluid separator fluidly connected to said fluid source and capable of operating at an internal pressure of no more than about ½ of said external water pressure and having a nominal vertical dimension of at least about 40 feet and a nominal horizontal dimension of no more than about 4 feet;

a tubular assembly fluidly connected to an upper fluid outlet of said fluid separator, said tubular assembly capable of transmitting a substantially separated fluid from said fluid separator to a nominal surface location;

a pump fluidly connected to a lower fluid outlet of said fluid separator that is capable of transmitting a second substantially separated fluid from said separator; and pump operating controls at least partially dependant upon a fluid interface level within said separator and capable of operating said pump with a fluid interface level within said separator that can vary at least about 30 feet along a nominal vertical dimension and wherein tools are capable of being lowered through said fluid separator and tubular assembly.

23. The apparatus of claim 22 wherein said nominal vertical dimension is capable of allowing said fluid interface level to vary with anticipated changes in fluid source conditions for a period of at least about 20 seconds until said pump responds to corresponding changes in the height of said fluid interface level in said separator.

24. The apparatus of claim 23 wherein said pump speed is at least in part controlled by changes in height of said fluid interface level within said separator.

25. An offshore apparatus for separating fluids from a multi-phase fluid source, said apparatus located at a water depth of at least about 1,500 feet from a surface location and subjected to the external water pressure at that depth, said apparatus comprising:

a fluid separator capable of operating at an internal pressure of no more than about ½ of said external water pressure and having a nominal vertical dimension of at least about 50 feet and a nominal horizontal dimension of no more than about 4 feet, said separator fluidly connected to said multi-phase fluid source;

a first tubular assembly fluidly connected to an upper fluid outlet of said fluid separator, said tubular assembly extending from said fluid separator to a near-surface location;

a pump fluidly connected to a lower fluid outlet of said fluid separator, wherein said pump is capable of operating with a fluid interface level within said separator that can vary at least about 40 feet along the nominal vertical dimension; and a pump discharge conduit that is at least in part coaxial with and proximate to said second tubular assembly.

26. The apparatus of claim 25 wherein at least a portion of said pump discharge conduit comprises a second tubular assembly within a portion of said first tubular assembly.

* * * * *

UNITED STATES PATENT AND TRADEMARK OFFICE

CERTIFICATE OF CORRECTION

PATENT NO. : 6,651,745 B1
DATED : November 25, 2003
INVENTOR(S) : David Lush et al.

It is certified that error appears in the above-identified patent and that said Letters Patent is hereby corrected as shown below:

Column 1,
Line 6, delete “the”
Line 22, after “riser” delete “and” and insert -- with --.
Line 23, delete “that is”.
Line 57, insert -- which -- before “preferably”.
Line 57, insert -- comprises a -- after “preferably”.
Line 57, insert -- pump -- after “driven”.

Column 2,
Line 2, insert -- the -- before “simplicity”.
Line 13, insert -- a -- before “side”.
Line 57, insert -- line 11 -- after “outlet”.

Column 3,
Line 59, after “separator 6 or” insert -- the --.
Line 60, insert -- 6 -- after “separator”.
Line 60, delete “in other embodiments”.
Line 64, delete “mostly” before “using”.
Line 64, delete “handling” before “equipment”.
Line 65, delete “used” and insert -- adapted --.
Line 65, delete “sections” and insert -- handling --.

Column 4,
Line 15, delete “11a” and insert -- 11 --.
Line 29, insert -- lower -- before “liquid outlet”.

Column 5,
Line 13, delete “2” and insert -- of the invention --.
Line 17, delete “ verticle” and insert -- tubular --.
Line 36, delete “separation” and insert -- fluid delivery --.

Column 6,
Line 11, after “reservoirs” delete “is” and insert -- are --.
Line 17, after “especially” insert -- when --.
Line 29, delete “8a” and insert -- 8 --.
Line 54, after “embodiment” insert -- of the invention--.
Line 57, delete “12” and insert -- 12R --.

Column 7,
Line 1, delete “6a” and insert -- 6 --.

UNITED STATES PATENT AND TRADEMARK OFFICE

CERTIFICATE OF CORRECTION

PATENT NO. : 6,651,745 B1
DATED : November 25, 2003
INVENTOR(S) : David Lush et al.

It is certified that error appears in the above-identified patent and that said Letters Patent is hereby corrected as shown below:

Column 7 cont,
Line 8, delete “bolted, threaded” and insert -- bolting, threading --.
Line 18, before “12” insert -- (item --.
Line 18, after “12” insert -- in FIG. 1 and item 12R in FIG. 2) --.
Line 21, delete “vertical seperator” and insert -- separators --.
Line 30, delete “7” and insert -- 8 --.
Line 58, after “6” (first occurrence) insert -- in FIG. 2 --.
Line 58, after “6” (second occurrence) insert -- in FIG. 1 --.
Line 60, delete “section” and insert -- sections --.

Column 8,
Line 1, after “tubulars,” insert -- thereby --.
Line 9, delete “The” and insert -- Referring again to FIG. 2, the --.
Line 11, after “6.” delete “After the” and insert -- The --.
Line 16, after “may” delete “use” and insert -- comprise --.
Line 33, 35, and 38, after “assembly” delete “7” and insert -- 8 --.
Line 42, delete “the riser” and insert -- these tublar --.
Line 42, after “sections” delete “8”.
Line 42, after “assembly” delete “7” and insert -- 8 --.
Line 43, before “coupling” insert -- of --.
Line 47, 59, 60 and 67, after “assembly” delete “7” and insert -- 8 --.

Column 9,
Line 3, after “FIG.” delete “2” and insert -- 1 --.

Column 10,
Line 3, delete “hydraulic” and insert -- hydraulically-driven --.
Lines 6,and 8, insert -- fluid -- before “separator”.
Line 46, delete “separator” (second occurrence).
Line 66, after “water” delete “-”.

UNITED STATES PATENT AND TRADEMARK OFFICE

CERTIFICATE OF CORRECTION

PATENT NO. : 6,651,745 B1
DATED : November 25, 2003
INVENTOR(S) : David Lush et al.

It is certified that error appears in the above-identified patent and that said Letters Patent is hereby corrected as shown below:

Column 12,
Line 35, delete "second" and insert -- first --.

Signed and Sealed this

Eighth Day of June, 2004

JON W. DUDAS
*Acting Director of the United States Patent and Trademark Office*